US012042704B2

(12) United States Patent
Gushulak

(10) Patent No.: US 12,042,704 B2
(45) Date of Patent: Jul. 23, 2024

(54) GOLF CLUB TRACKING ASSEMBLY

(71) Applicant: Grant Gushulak, Calgary (CA)

(72) Inventor: Grant Gushulak, Calgary (CA)

( * ) Notice: Subject to any disclaimer, the term of this patent is extended or adjusted under 35 U.S.C. 154(b) by 224 days.

(21) Appl. No.: 17/738,095

(22) Filed: May 6, 2022

(65) Prior Publication Data

US 2023/0356046 A1 Nov. 9, 2023

(51) Int. Cl.
*A63B 55/00* (2015.01)
*A63B 60/06* (2015.01)

(52) U.S. Cl.
CPC ..... *A63B 55/00* (2013.01); *A63B 60/06* (2015.10); *A63B 2055/402* (2015.10); *A63B 2225/54* (2013.01)

(58) Field of Classification Search
CPC ... A63B 55/00; A63B 60/06; A63B 2055/402; A63B 2225/54
See application file for complete search history.

(56) References Cited

U.S. PATENT DOCUMENTS

| | | | | |
|---|---|---|---|---|
| D488,847 | S | 4/2004 | Miller | |
| 7,106,195 | B2 | 9/2006 | Keays | |
| 9,248,353 | B1 | 2/2016 | Koenig | |
| 9,694,263 | B2 | 7/2017 | Savarese | |
| 10,427,016 | B1 * | 10/2019 | Richmond | G08B 21/0277 |
| 2004/0147329 | A1 * | 7/2004 | Meadows | G01S 19/19 473/131 |
| 2006/0255918 | A1 | 11/2006 | Bernstein | |
| 2007/0191126 | A1 | 8/2007 | Mandracken | |
| 2011/0304460 | A1 * | 12/2011 | Keecheril | G08B 21/025 340/572.1 |
| 2012/0249330 | A1 * | 10/2012 | Savarese | G08B 21/24 340/568.6 |
| 2022/0105399 | A1 * | 4/2022 | Isgar | A63B 71/0669 |

FOREIGN PATENT DOCUMENTS

| | | |
|---|---|---|
| WO | WO2006053188 | 5/2006 |

* cited by examiner

*Primary Examiner* — Sisay Yacob

(57) ABSTRACT

A golf club tracking assembly includes a plurality of golf clubs and a golf bag for storing the golf clubs. A personal electronic device is provided that has wireless communication capabilities. A plurality of tracking units is each attached to a respective one of the golf clubs. A base unit is integrated into the golf bag and the base unit is in remote communication with the personal electronic device thereby facilitating the personal electronic device to download the number of tracking units that is assigned to the golf bag. The base unit is in remote communication with each of the tracking units and the base unit generates an alert when the base unit ceases communicating with any of the tracking units. In this way a user is alerted that one or more golf clubs is missing from the golf bag to inhibit the golf clubs from being lost or misplaced.

5 Claims, 5 Drawing Sheets

GOLF CLUB TRACKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tracking devices and more particularly pertains to a new tracking device for inhibiting golf clubs from being inadvertently left on a golf course. The device includes a plurality of tracking units that are each attached to respective golf club. The device includes a base unit that is attached to a golf bag in which the golf clubs are stored and the base unit is in wireless communication with each of the tracking units. The device includes a light emitter which emits a first color of light when all of the golf clubs are present in the golf bag and which emits a second color of light when one or more of the golf clubs is removed from the golf bag.

(2) Description of Related Art Including Information Disclosed Under 37 CFR 1.97 and 1.98

The prior art relates to tracking devices including a golf club tracking device that employs a capacitance based proximity sensor and a light emitter that is activated when one or more golf clubs is missing from a golf bag. The prior art discloses a golf club tracking device that includes a plurality of transmitters, each attached to a respective golf club and a base unit that is removably attached to a golf bag and which employs global positioning data to track the location of the golf clubs. The prior art discloses a golf club tracking device that includes a plurality of radio frequency identification tags each attached to a golf club and a personal electronic device that is in communication with each of the radio frequency identification tags. The prior art discloses a golf club tracking device that includes a plurality of golf tags each attached to a respective golf club, a golfer tag attached to a golfer and a base detector that is in wireless communication with the plurality of golf tags and the golfer tag. The prior art discloses a golf club tracking unit that includes a plurality of radio frequency identification tags each attached to a golf club, a tracking unit that is that is wearable on a golfer that emits an alert when one or more of the radio frequency identification tags is not in communication with the tracking unit. The prior art discloses a golf club tracking device that includes a plurality of transceivers each attached to a respective golf club and a base unit that is in wireless communication with the transceivers. The base unit transmits a signal to each of the transceivers and the base unit emits an alert when any of the transceivers does not reply to the base unit.

BRIEF SUMMARY OF THE INVENTION

An embodiment of the disclosure meets the needs presented above by generally comprising a plurality of golf clubs and a golf bag for storing the golf clubs. A personal electronic device is provided that has wireless communication capabilities. A plurality of tracking units is each attached to a respective one of the golf clubs. A base unit is integrated into the golf bag and the base unit is in remote communication with the personal electronic device thereby facilitating the personal electronic device to download the number of tracking units that is assigned to the golf bag. The base unit is in remote communication with each of the tracking units and the base unit generates an alert when the base unit ceases communicating with any of the tracking units. In this way a user is alerted that one or more golf clubs is missing from the golf bag to inhibit the golf clubs from being lost or misplaced.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
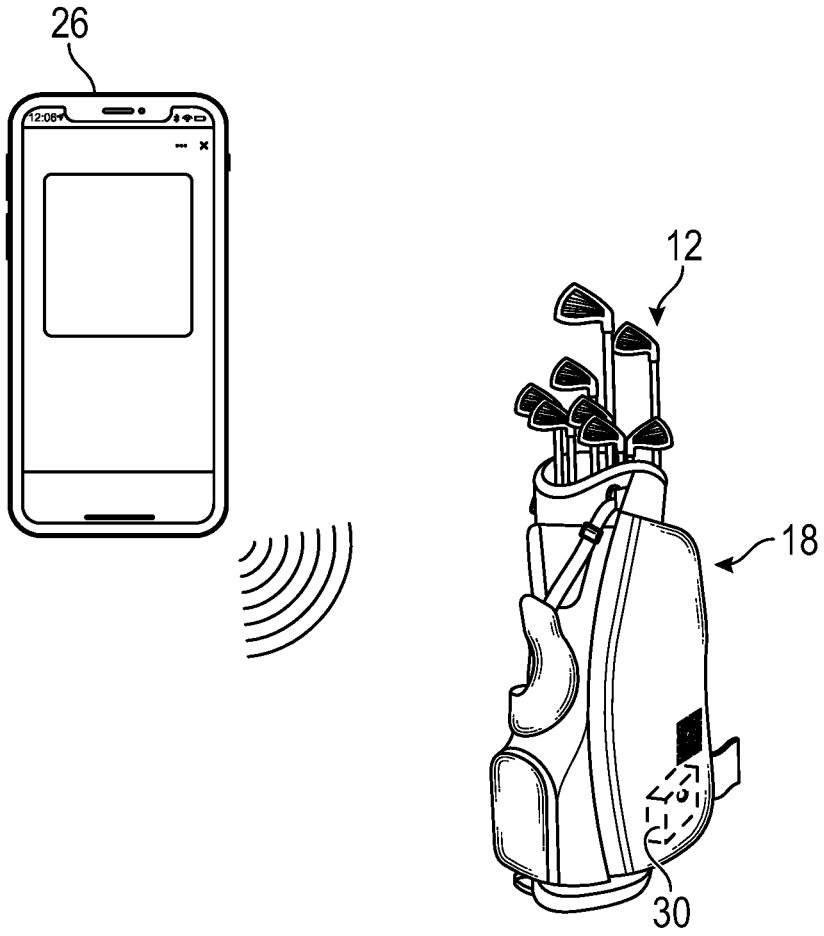
FIG. 1 is a perspective view of a golf club tracking assembly according to an embodiment of the disclosure.
Figure 2:
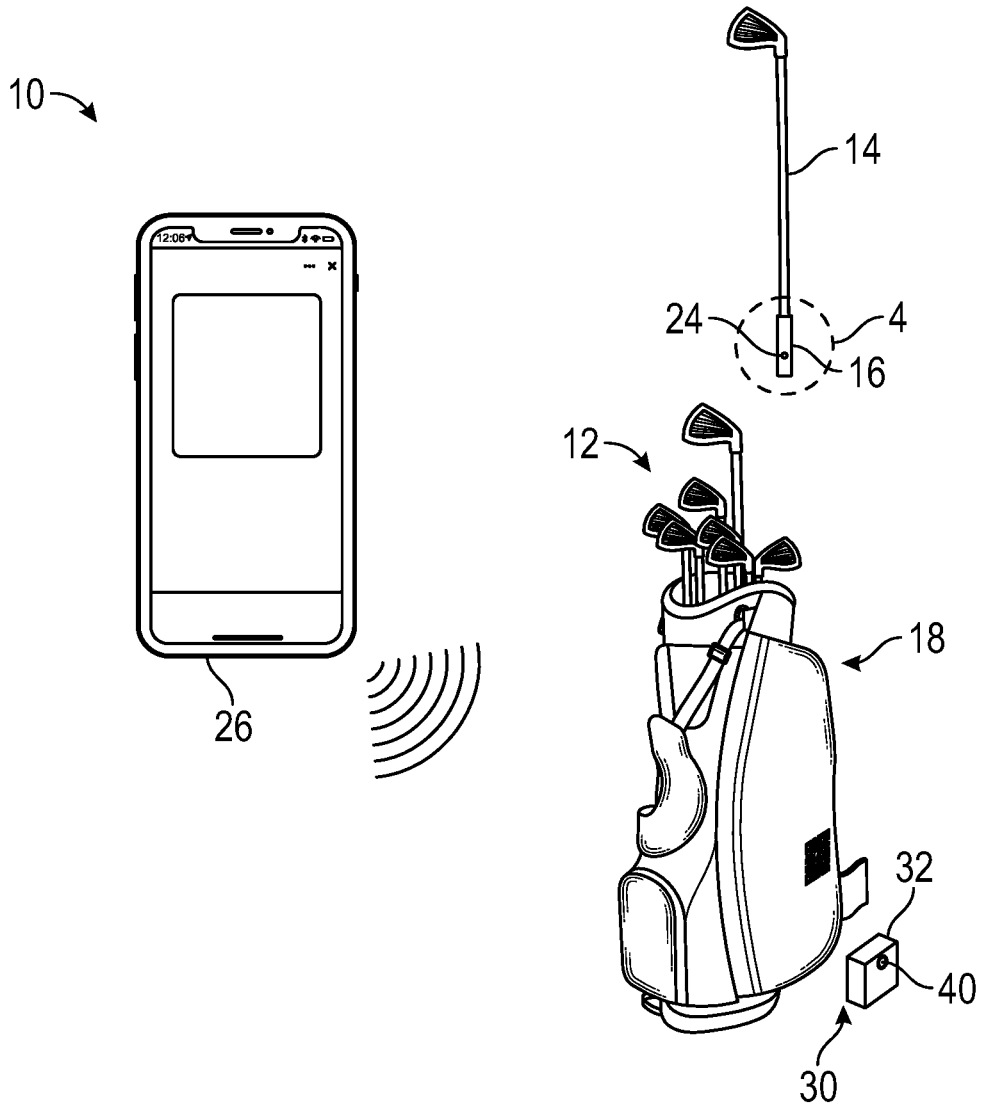
FIG. 2 is an exploded perspective view of an embodiment of the disclosure.
Figure 3:
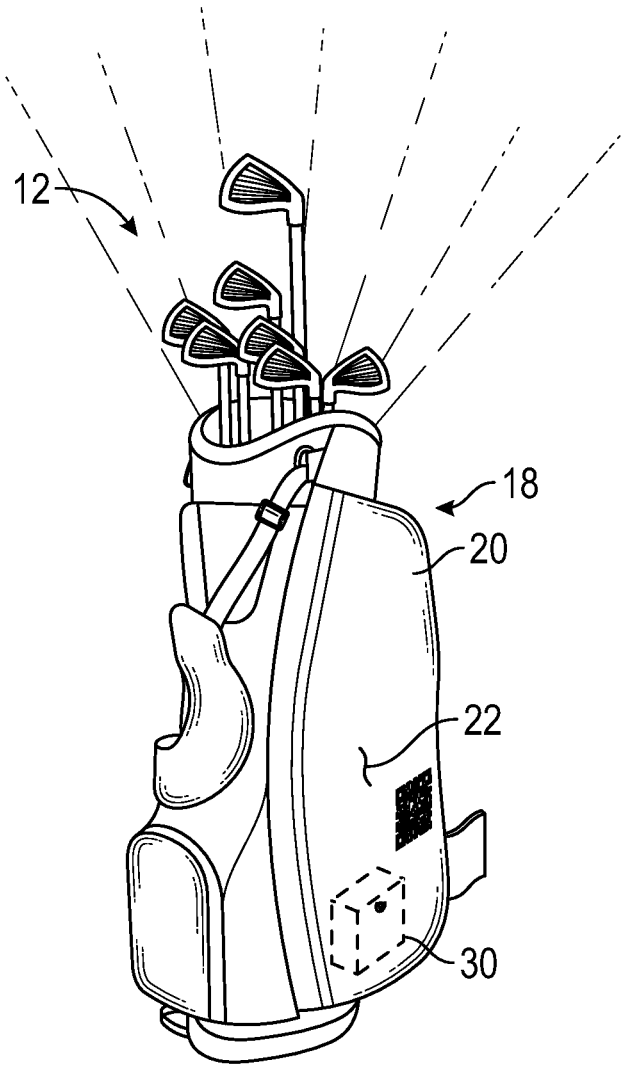
FIG. 3 is a phantom in-use view of an embodiment of the disclosure.
Figure 4:
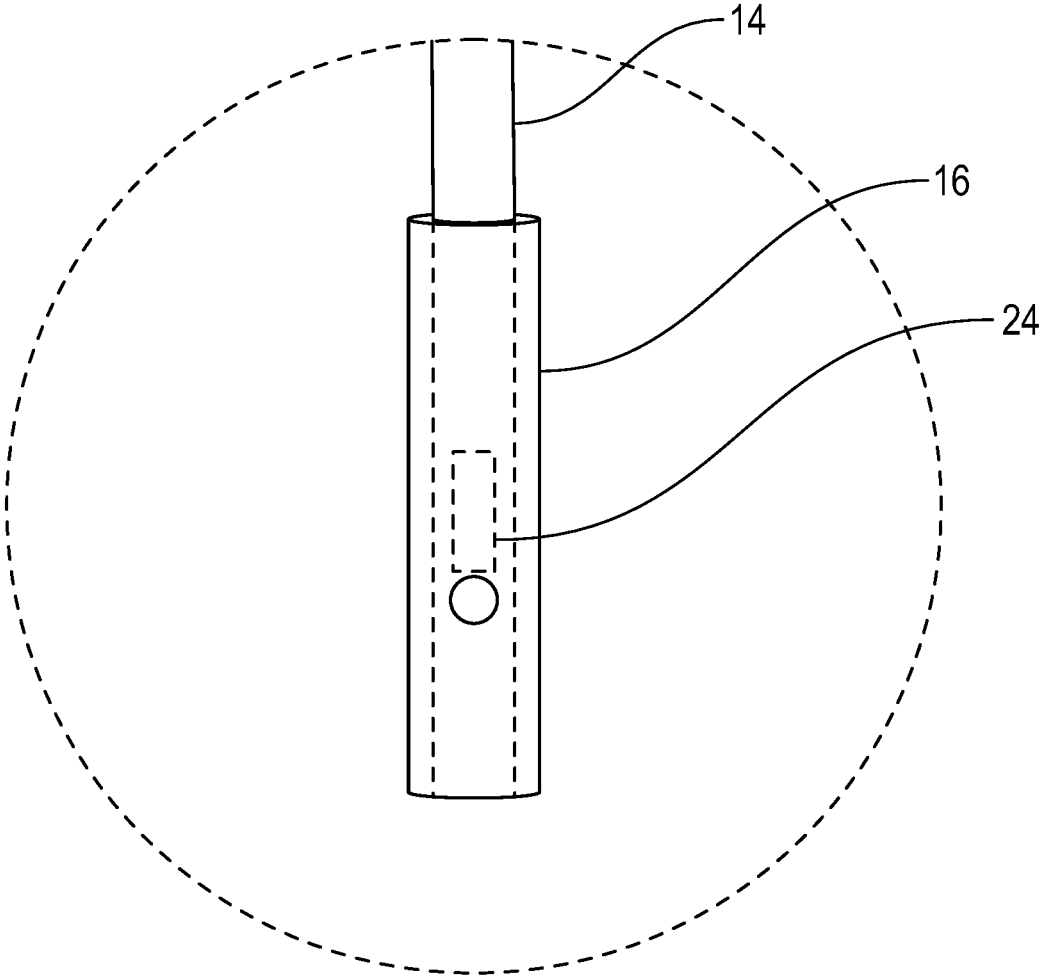
FIG. 4 is a magnified detail view taken from circle 4 of FIG. 2 of an embodiment of the disclosure.
Figure 5:
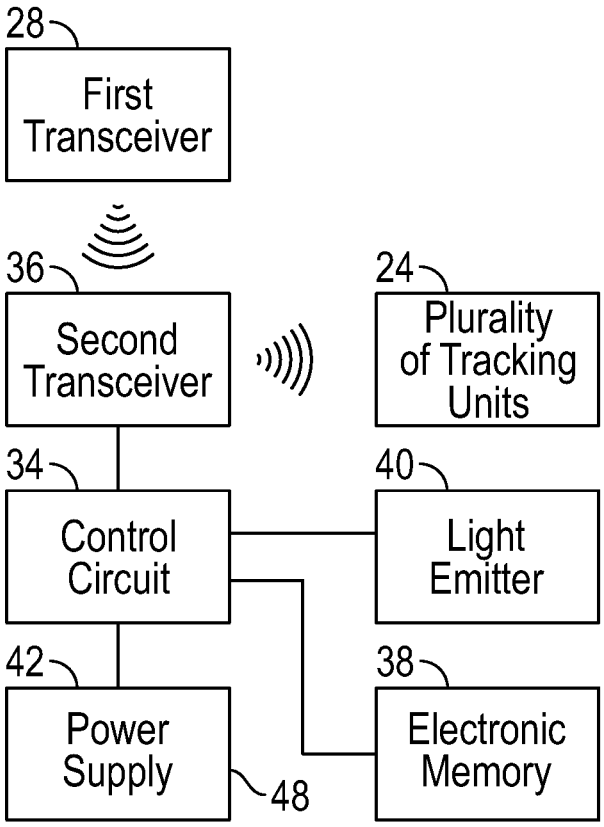
FIG. 5 is a schematic view of an embodiment of the disclosure.

With reference now to the drawings, and in particular to FIGS. 1 through 5 thereof, a new tracking device embodying the principles and concepts of an embodiment of the disclosure and generally designated by the reference numeral 10 will be described.

As best illustrated in FIGS. 1 through 5, the golf club tracking assembly 10 generally comprises a plurality of golf clubs 12 that each has a shaft 14 and a grip 16 positioned around the shaft 14. The plurality of golf clubs 12 may include golf clubs commonly employed in the game of golf, including drivers, irons and putters. A golf bag 18 is provided, each of the golf clubs 12 is stored in the golf bag 18, the golf bag 18 has an outer wall 20 and the outer wall 20 has an inside surface 22. The golf bag 18 may be a golf bag of any conventional design that is employed for storing and transporting golf clubs.

A plurality of tracking units 24 is provided, each of the tracking units 24 is attached to a respective one of the golf clubs 12 and each of the tracking units 24 is assigned a unique identity with respect to each other. Each of the tracking units 24 is positioned on the shaft 14 of the respective golf club 12 such that the tracking units 24 are positioned beneath the grip 16 on the respective golf club 12. In this way the tracking units 24 are concealed from view and the tracking units 24 are inhibited from being removed from the respective golf clubs 12. Each of the tracking units 24 may comprise a radio frequency identification device of any conventional design that employs a radio frequency transponder, and each of the tracking units 24 may have an effective range of no greater than 0.5 meters. A personal electronic device 26 is provided that has wireless communication capabilities and the personal electronic device 26 includes a first transceiver 28. The personal electronic device 26 may comprise a smart phone or other similar type of electronic device and the personal electronic device 26 may store an operational program, such as a smart phone app or the like, for choosing the number of tracking devices that is being employed.

A base unit 30 is integrated into the golf bag 18 and the base unit 30 is in remote communication with the personal electronic device 26 thereby facilitating the personal electronic device 26 to download the number of tracking units 24 assigned to the golf bag 18. The base unit 30 is in remote communication with each of the tracking units 24 and the base unit 30 generates an alert when the base unit 30 ceases communicating with any of the tracking units 24. In this way the base unit 30 can alert a user that one or more golf clubs 12 is missing from the golf bag 18 to inhibit the golf clubs 12 from being lost or misplaced.

The base unit 30 comprises a housing 32 that is attached to the inside surface 22 of the golf bag 18 and a control circuit 34 that is positioned within the housing 32. The control circuit 34 receives a confirm input and the control circuit 34 receives an alert input. The base unit 30 includes a second transceiver 36 that is positioned within the housing 32 and the second transceiver 36 is electrically coupled to the control circuit 34. The second transceiver 36 is in wireless communication with the first transceiver 28 and the second transceiver 36 is in wireless communication with each of the tracking units 24. Furthermore, the control circuit 34 receives the alert input when the second transceiver 36 ceases communication with any of the tracking units 24 and the control circuit 34 receives the confirm input when the second transceiver 36 is in communication with all of the tracking units 24. The second transceiver 36 may comprise a radio frequency transceiver or the like and the second transceiver 36 may employ Bluetooth communication protocols.

The base unit 30 includes an electronic memory 38 that is positioned within the housing 32 and the electronic memory 38 is electrically coupled to the control circuit 34. The electronic memory 38 stores a database comprising the unique identities of each of the tracking units 24 that is downloaded from the personal electronic device 26. The base unit 30 includes a light emitter 40 that is coupled to the housing 32 to emit light into an interior of the golf bag 18 and the light emitter 40 is electrically coupled to the control circuit 34. The light emitter 40 is actuated to emit a first color of light when the control circuit 34 receives the confirm input to visually communicate to the user that all of the golf clubs 12 are positioned in the golf bag 18. Conversely, the light emitter 40 is actuated to emit a second color of light when the control circuit 34 receives the alert input to visually alert the user that one or more of the golf clubs 12 is missing from the golf bag 18. The first color of light may be green, the second color of light may be red and the light emitter 40 may comprise a light emitting diode or other electronic light emitter 40. The base unit 30 includes a power supply 42 that is positioned in the housing 32, the power supply 42 is electrically coupled to the control circuit 34 and the power supply 42 comprises at least one battery 44.

In use, the personal electronic device 26 is employed to download the number of tracking units 24 that is being employed into the electronic memory 38 in the base unit 30. In this way the light emitter 40 emits the first color of light when all of the golf clubs 12 are placed in the golf bag 18 to visually communicate the all of the golf clubs 12 are accounted for. The light emitter 40 emits the second color of light when one or more of the golf clubs 12 are removed from the golf bag 18. In this way the golf clubs 12 are inhibited from being inadvertently left on a golf course, for example, or otherwise lost or misplaced. Additionally, the personal electronic device 26 produces an alert a predetermined duration of time after the control circuit 34 receives the alert input to further inhibit the golf clubs 12 from being left on the golf course.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf club tracking assembly for inhibiting golf clubs from being lost or misplaced, said assembly comprising:

a plurality of golf clubs;

a golf bag having each of said golf clubs being stored in said golf bag;

a personal electronic device having wireless communication capabilities;

a plurality of tracking units, each of said tracking units being attached to a respective one of said golf clubs, each of said tracking units being assigned a unique identity with respect to each other;

a base unit being integrated into said golf bag, said base unit being in remote communication with said personal electronic device thereby facilitating said personal electronic device to download the number of tracking units being assigned to said golf bag, said base unit being in remote communication with each of said tracking units, said base unit generating an alert when said base unit ceases communicating with any of said tracking units to alert a user that one or more golf clubs is missing from said golf bag wherein said base unit is configured to inhibit said golf clubs from being lost or misplaced;

wherein said golf bag has an outer wall, said outer wall having an inside surface;

wherein said base unit comprises a housing being attached to said inside surface of said golf bag;

wherein said personal electronic device includes a first transceiver; and wherein said base unit includes:

a control circuit is positioned within said housing, said control circuit receiving a confirm input, said control circuit receiving an alert input; and a second transceiver being positioned within said housing, said second transceiver being electrically coupled to said control circuit, said second transceiver being in wireless communication with said first transceiver, said second transceiver being in wireless communication with each of said tracking units, said control circuit receiving said alert input when said second transceiver ceases communication with any of said tracking units, said control circuit receiving said confirm input when said second transceiver is in communication with all of said tracking units.

2. The assembly according to claim 1, wherein:

each of said golf clubs has a shaft and a grip positioned around said shaft; and each of said tracking units is positioned on said shaft of said respective golf club such that said tracking units are positioned beneath said grip on said respective golf club.

3. The assembly according to claim 1, wherein said base unit includes an electronic memory being positioned within said housing, said electronic memory being electrically coupled to said control circuit, said electronic memory storing a database comprising said unique identities of each of said tracking units being downloaded from said personal electronic device.

4. The assembly according to claim 1, wherein:

said base unit includes a light emitter being coupled to said housing wherein said light emitter is configured to emit light into an interior of said golf bag, said light emitter being electrically coupled to said control circuit;

said light emitter is actuated to emit a first color of light when said control circuit receives said confirm input wherein said light emitter is configured to visually communicate to the user that all of said golf clubs are positioned in said golf bag; and said light emitter is actuated to emit a second color of light when said control circuit receives said alert input wherein said light emitter is configured to visually alert the user that one or more of said golf clubs is missing from said golf bag.

5. A golf club tracking assembly for inhibiting golf clubs from being lost or misplaced, said assembly comprising:

a plurality of golf clubs, each of said golf clubs having a shaft and a grip positioned around said shaft;

a golf bag having each of said golf clubs being stored in said golf bag, said golf bag having an outer wall, said outer wall having an inside surface;

a personal electronic device having wireless communication capabilities, said personal electronic device including a first transceiver;

a plurality of tracking units, each of said tracking units being attached to a respective one of said golf clubs, each of said tracking units being assigned a unique identity with respect to each other, each of said tracking units being positioned on said shaft of said respective golf club such that said tracking units are positioned beneath said grip on said respective golf club;

a base unit being integrated into said golf bag, said base unit being in remote communication with said personal electronic device thereby facilitating said personal electronic device to download the number of tracking units being assigned to said golf bag, said base unit being in remote communication with each of said tracking units, said base unit generating an alert when said base unit ceases communicating with any of said tracking units to alert a user that one or more golf clubs is missing from said golf bag wherein said base unit is configured to inhibit said golf clubs from being lost or misplaced, said base unit comprising:

a housing being attached to said inside surface of said golf bag;

a control circuit being positioned within said housing, said control circuit receiving a confirm input, said control circuit receiving an alert input;

a second transceiver being positioned within said housing, said second transceiver being electrically coupled to said control circuit, said second transceiver being in wireless communication with said first transceiver, said second transceiver being in wireless communication with each of said tracking units, said control circuit receiving said alert input when said second transceiver ceases communication with any of said tracking units, said control circuit receiving said confirm input when said second transceiver is in communication with all of said tracking units;

an electronic memory being positioned within said housing, said electronic memory being electrically coupled to said control circuit, said electronic memory storing a database comprising said unique identities of each of said tracking units being downloaded from said personal electronic device;

a light emitter being coupled to said housing wherein said light emitter is configured to emit light into an interior of said golf bag, said light emitter being electrically coupled to said control circuit, said light emitter being actuated to emit a first color of light when said control circuit receives said confirm input wherein said light emitter is configured to visually communicate to the user that all of said golf clubs are positioned in said golf bag, said light emitter being actuated to emit a second color of light when said control circuit receives said alert input wherein said light emitter is configured to visually alert the user that one or more of said golf clubs is missing from said golf bag; and a power supply being positioned in said housing, said power supply being electrically coupled to said control circuit, said power supply comprising at least one battery.

* * * * *